US005164776A

United States Patent [19]

Oresick et al.

[11] Patent Number: 5,164,776

[45] Date of Patent: Nov. 17, 1992

[54] APPARATUS AND METHOD FOR CORRECTING THE VOLTAGE ON A PHOTOCONDUCTIVE DEVICE

[75] Inventors: Carl F. Oresick, Rochester; Richard A. Lux, Webster; Debbie S. Wickham, Macedon; Daniel J. Dobranski, Fairport, all of N.Y.

[73] Assignee: Xerox Corporation, Stamford, Conn.

[21] Appl. No.: 762,207

[22] Filed: Sep. 19, 1991

[51] Int. Cl.[5] ..... G03G 15/00; G03G 15/02

[52] U.S. Cl. ..... 355/208; 355/219

[58] Field of Search ..... 355/204, 208, 216, 219, 355/225

[56] References Cited

U.S. PATENT DOCUMENTS

| | | | |
|---|---|---|---|
| 2,956,487 | 10/1960 | Giaimo, Jr. | 95/1.7 |
| 3,335,274 | 8/1967 | Codichini et al. . | |
| 3,496,351 | 2/1970 | Cunningham, Jr. | 250/4.5 |
| 3,604,925 | 9/1971 | Snelling et al. . | |
| 3,688,107 | 8/1972 | Schneider et al. . | |
| 3,699,388 | 10/1972 | Ukai . | |
| 3,934,141 | 1/1976 | Vargas, Jr. . | |
| 3,935,532 | 1/1976 | Shuey et al. . | |
| 4,435,677 | 3/1984 | Thomas . | |
| 4,502,777 | 3/1985 | Okamoto et al. . | |
| 4,512,652 | 4/1985 | Buck et al. | 355/219 |
| 4,796,064 | 1/1989 | Torrey . | |
| 4,806,980 | 2/1989 | Jamzadeh et al. | 355/208 |
| 4,920,830 | 4/1990 | Ueda et al. | 355/219 |
| 4,935,777 | 6/1990 | Noguchi et al. | 355/219 X |
| 4,939,542 | 7/1990 | Kurando et al. | 355/208 |
| 4,970,557 | 11/1990 | Masuda et al. | 355/208 X |
| 5,003,350 | 3/1991 | Yui et al. | 355/225 |

FOREIGN PATENT DOCUMENTS

| | | | |
|---|---|---|---|
| 61-62075 | 3/1986 | Japan | 355/208 |
| 62-44755 | 2/1987 | Japan | 355/208 |

*Primary Examiner*—Joan H. Pendegrass

[57] ABSTRACT

An apparatus and method for maintaining a constant voltage potential on a photoconductive member within an electrophotographic printing system comprises and utilizes, respectively, a charging device, a voltage monitor and a controller. The charging device produces a voltage potential on a photoconductive member within the electrophotographic printing system. The voltage monitor measures the voltage on the photoconductive member and generates a voltage measured signal. The controller, responsive to the voltage measure signal, stores a target voltage value and computes the difference of the measured voltage signal and the target voltage value to obtain a voltage error for a prior print job. The controller computes a predicted control signal for the corresponding cycle of the next successive print job as a function of the voltage error and regulates the charging device for the corresponding cycle of the next successive print job as a function of the predicted control signal.

8 Claims, 3 Drawing Sheets

APPARATUS AND METHOD FOR CORRECTING THE VOLTAGE ON A PHOTOCONDUCTIVE DEVICE

BACKGROUND OF THE INVENTION

1. Field of the Invention

This invention relates generally to an electrophotographic printing system, and more particularly concerns an apparatus and method for controlling charging of a photoconductive member.

2. Description of the Prior Art

The basic xerographic process comprises exposing a charged photoconductive member to a light image of an original document. The irradiated areas of the photoconductive surface are discharged to record thereon an electrostatic latent image corresponding to the original document. A development system, thereupon, moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. The sheet of support material then advances to a fuser which permanently affixes the toner powder image thereto.

Before the photoconductive member can be exposed to a light image, the photoconductive member must be charged by a suitable device. This operation is typically performed by a corona charging device. One type of corona generator consists of a current carrying wire enclosed by a shield on three sides and a wire grid over and spaced apart from the open side of the shield. A uniform potential is applied to the wire and the wire grid. Electrostatic fields develop between the charged wire and the shield, between the wire and the grid, and between the charged wire and the (grounded) photoconductive member. Electrons are repelled from the wire and the shield resulting in a charge at the surface of the photoconductive member. The wire grid, located between the wire and the photoconductive members, because of the field between the grid and the wire, helps control the charge strength and uniformity on the photoconductive member caused by the other aforementioned fields.

The control of the charge strength and uniformity on the photoconductive member is very important because consistent high quality reproductions are best produced when a uniform charge is obtained on the photoconductive member. If the photoconductive member is not charged to a sufficient potential, the electrostatic latent image obtained upon exposure will be relatively weak and the resulting deposition of development material will be correspondingly lessened. As a result, the copy, produced therefrom, will be faded. If, however, the photoconductive member is overcharged, the converse will occur and too much developer material will be deposited on the photoconductive member. As a consequence thereof, the copy produced therefrom, will have a gray or dark background instead of the white background of the copy paper. Areas intended to be gray are black. Tone reproduction is poor. Additionally, if the photoconductive member is overcharged too much, the photoconductive member can be permanently damaged.

In a typical xerographic charging system, the amount of voltage obtained at the point of electrostatic voltage (ESV) measurement of the photoconductive member is less than the amount of voltage applied at the point of charge application. In addition, the amount of voltage applied to the corona generator required to obtain a desired constant voltage on the photoconductive member must be increased or decreased according to various factors which affect the photoconductive member. Such factors include the rest time of the photoconductive member between printing, the voltage applied to the corona generator for the previous printing job, the copy length of the previous printing job, machine to machine variance, the age of the photoconductive member and changes in the environment.

Historically, the only factor corrected in applying a voltage on the corona generator to obtain a uniform voltage at the photoconductive member was a rest recovery correction factor. The rest recovery factor attempted to correct for the fact that the photoreceptor responds to charges differently after it is allowed to rest at which time no charge is applied. Preferably, the manner of adjusting the voltage at the corona generator was to adjust the voltage applied to the wire grid.

For example, it would not be uncommon at the end of a 200 copy job for the corona charging device of a copier to generate 1200 volts to obtain 900 volts at the point of measurement on the photoconductive member as measured by an electrostatic voltmeter. After allowing the copier to remain idle for 15 minutes, the corona generator might then need to put out only 1000 volts to obtain 900 volts on the photoconductive member.

The classical rest recovery correction factor can be written as:

VOLTAGE grid correction =

VOLTAGE grid previous job − (Maximum Recovery) ×

(Percentage of Recovery).

otherwise written as: $[Vgc = Vgpj - MR \times \% R]$.

where Percentage of Recovery = A + B natural log (rest time), in which A and B were predetermined constants.

Although the classical rest recovery factor has proven beneficial in the control of the charge strength and uniformity on a photoconductive member, there is a need to correct the great many factors which affect the charge strength and uniformity on a photoconductive member.

The problems with typical xerographic charging control systems are not limited to the difficulties associated with rest recovery. In a typical charge control system, the point of charge application, and the point of charge measurement is different. The zone between these two devices loses the immediate benefit of charge control decisions based on measured voltage error since this zone is downstream from the charging device. This zone may be as great as a belt revolution or more due to charge averaging schemes. This problem is especially evident in aged photoreceptors because their cycle-to-cycle charging characteristics are more difficult to predict. The problem results in improper charging, often leading to early photoreceptor replacement. Thus, there is a need to anticipate what the next cycles behavior will be and compensate for it beforehand.

The following disclosures may be relevant to various aspects of the present invention:

U.S. Pat. No. 2,956,487, Patentee: E. C. Giaimo, Jr., Issued: Oct. 18, 1960;

U.S. Pat. No. 3,335,274, Patentee: Codichini et al., Issued: Aug. 8, 1967;

U.S. Pat. No. 3,469,351, Patentee: Cunningham, Jr., Issued: Feb. 17, 1970;

U.S. Pat. No. 3,604,925, Patentee: Snelling, Issued: Sep. 14, 1971;

U.S. Pat. No. 3,688,107, Patentee: Schneider et al., Issued: Aug. 29, 1972;

U.S. Pat. No. 3,699,388, Patentee: Ukai, Issued: Oct. 17, 1972;

U.S. Pat. No. 3,934,141, Patentee: Vargas, Jr., Issued: Jan. 20, 1976;

U.S. Pat. No. 3,935,532, Patentee: Shuey et al., Issued: Jan. 27, 1976;

U.S. Pat. No. 4,435,677, Patentee: Thomas, Issued: Mar. 6, 1984;

U.S. Pat. No. 4,502,777, Patentee: Okamoto et al., Issued: Mar. 5, 1985;

U.S. Pat. No. 4,512,652, Patentee: Buck et al., Issued: Apr. 23, 1985;

U.S. Pat. No. 4,796,064, Patentee: Torrey, Issued: Jan. 3, 1989;

U.S. Pat. No. 4,806,980, Patentee: Jamzadeh et al., Issued: Feb. 21, 1989;

U.S. Pat. No. 4,920,380, Patentee: Ueda et al., Issued: Apr. 24, 1990;

U.S. Pat. No. 4,935,777, Patentee: Noguchi et al., Issued: Jun. 19, 1990;

U.S. Pat. No. 4,939,542, Patentee: Kurando et al., Issued: Jul. 3, 1990;

U.S. Pat. No. 4,970,557, Patentee: Masuda et al., Issued: Nov. 13, 1990;

U.S. Pat. No. 5,003,350, Patentee: Yui et al., Issued: Mar. 26, 1991.

The relevant portions of the foregoing disclosures may be briefly summarized as follows:

U.S. Pat. No. 4,796,064 discloses a control device for adjusting the surface potential of an image bearing member during the initial cycles of a job run wherein the image bearing member manifests varying characteristics after completion of a job run. The control device includes logic circuitry having means to predict changed characteristics of the image bearing member after completion of a first job run at the initiation of a second job run and means to determine a relationship between a charging current of a charging member and a measured surface potential of the image bearing member. More specifically, the control device predicts the charging characteristics of the image bearing members as a function of a rest recovery and a cumulative sum of previous jobs.

U.S. Pat. No. 4,512,652 discloses an electrophotographic printing machine wherein a controller regulates charging of a photoconductor member according to stored information. The controller determines a charging current as a function of a "start of day" charging current, a previous operating cycle charging current, and/or a rest time between successive copying cycles.

U.S. Pat. No. 4,806,980 discloses a feedforward process control for an electrophotographic machine wherein an initial voltage level and an exposure level are process control parameters of the machine. Signals are produced and stored having values characteristics of: (1) a level of at least one of the parameters; and (2) a bias voltage level. A comparison signal is produced by comparing the signal values of charges and the sensed parameters associated with the latent images with the stored signal values for the corresponding latent charge images. Compensation algorithms are used to compensate for noise and disturbances in the initial charge. The feedforward process control acts in an anticipatory manner before the effect of the noise and disturbances affects the results.

U.S. Pat. No. 4,939,542 discloses an image forming apparatus having: (1) a memory means for storing a measured value of a surface potential of a photoreceptor drum obtained by a potential sensor; and (2) a charger-output control means for controlling an output from a charger, based on the measured value stored in the memory means. The charger-output control means obtains a value at the surface potential of the photoreceptor which is measured by the potential sensor at a time when a voltage from a voltage generation circuit is applied to the photoreceptor by operating a switching means, estimated by an arithmetic operation based on the measured value obtained. The output charger, at the next series of image forming operations, is adjusted to be equal to the measured value that has been read out by the potential sensor.

U.S. Pat. No. 4,502,777 discloses an electrophotographic copying apparatus which includes: (1) a device for detecting conditions affecting the operating characteristics of a photoreceptor; (2) a device for determining a state of operation of an image forming device according to the conditions detected by the detecting device; (3) a device for correcting the state of operation of an image forming device so as to render a potential of a latent image formed on a photoreceptor surface; and (4) a device for revising a reference equation based on the conditions detected by the detecting device and the state of operation which has been corrected by the correcting device. The conditions have a predetermined relationship which are represented by a predetermined reference equation.

U.S. Pat. No. 4,435,677 discloses a power regulating device which maintains a constant rms voltage across a load by periodically interrupting an application of voltage to the load at a predetermined number of cycles. A function solution to a equation is incorporated into the device which describes a relationship between the rms voltage developed across the load and rms voltage of a desired control set point. The solution of the equation is monitored so as to reach a fixed value. When a fixed value is reached, a primary current flow to the load is interrupted for a predetermined number of half or full cycles.

U.S. Pat. No. 4,920,380 discloses a method for controlling electric potential on the surface of a photoconductive member. The electric potential of a photoconductive member is always maintained at a certain value by controlling a charge output of a charging means at a predetermined value. After a long period of suspended operation, an initial charge output is lowered according to the length of the suspended operation. Subsequently, the charged output is gradually increased to a predetermined value so that the surface potential of the photoconductive member is always maintained at a specific constant value.

U.S. Pat. No. 4,935,777 discloses a method of stabilizing surface potential of a charged photoreceptor wherein a level of exposure of charge removing light is modified according to fatigue and recovery characteristics of the photoreceptor. During a continuous operation of the photoreceptor, the level is logarithmically reduced, and after a rest period, the initial level of exposure is logarithmically increased as a function of the length of the rest period and the level of exposure prior to the rest period.

U.S. Pat. No. 4,970,557 discloses a method for controlling image quality for an electrophotographic process according to the duration of a rest period and a cumulative copy count. The speed of development of the electrophotographic apparatus is decreased with increasing rest period duration and is increased as the cumulative copy count increases.

U.S. Pat. No. 5,003,350 discloses a method for controlling a voltage applied to a charging grid for charging a photoreceptor. The voltage is controlled as a function of either the number of rotations or the rotation time of the photoreceptor in order to maintain the voltage of the photoreceptor at a constant level.

U.S. Pat. No. 3,935,532 discloses an electrometer system particularly adapted for non-contact measurement of electrostatic charges in electrostatography, such as the charge level on photoreceptor surface areas in xerographic machines. The electrometer circuit disclosed therein may be used for automatic diagnostics or automatic control of one or more xerographic processing elements.

U.S. Pat. No. 3,335,274 discloses a xerographic charging apparatus with means to automatically control the potential applied to a corona wire. Through the automatic control of the potential of the corona wire, a uniform electrostatic charge may be deposited on a xerographic plate.

U.S. Pat. No. 3,604,925 discloses an apparatus for automatically controlling the amount of electrostatic charge applied to a plate by controlling the potential applied to a corona wire. An electrical circuit in a corona generating device is utilized to deposit a uniform charge on a xerographic plate.

U.S. Pat. No. 3,496,351 discloses a control circuit for a corona charging device for use in charging the xerographic plate in a stepping xerographic apparatus whereby a uniform electrostatic charge is applied to the xerographic plate at any stepping rate of the xerographic plate.

U.S. Pat. No. 2,956,487 discloses a method and means for controlling the steps of electrostatic printing. Controlling means can produce a control signal which may used to control the magnitude of electrostatic charge produced on a photoconductive coating. A voltage source is varied by varying the voltage applied to a grid closely spaced between the wires of a corona discharge apparatus and the photoconductive coating.

U.S. Pat. No. 3,934,141 discloses an apparatus for automatically regulating the amount of charge applied to an insulating surface such as a photoreceptor. An electrometer, for measuring the electrostatic potential on the insulating surface, is utilized to generate an error signal. In response to the error signal, the magnitude of the voltage applied by the power supply to a corona electrode is varied. The variation in the voltage magnitude causes the wire to apply sufficient charge to the insulating surface to reduce the error signal to substantially zero.

U.S. Pat. No. 3,688,107 discloses an electrical configuration for a corona generating device whereby a uniform electrostatic charge may be rapidly deposited on an electrostatographic plate.

U.S. Pat. No. 3,699,388 discloses an electrostatic charging apparatus having a means to maintain the magnitude of the discharge field thereof constant. A detection electrode is positioned in the field of the corona discharge and is connected via a resistor and amplifier to the power source to control the same in accordance with the detected corona discharge.

SUMMARY OF THE INVENTION

In accordance with one aspect of the present invention, there is provided an electrophotographic printing machine of the type having a latent image recorded on a photoconductive member during successive printing cycles of successive print jobs. The improvement comprises a charging device for producing a voltage potential on the photoconductive member, a voltage monitor for measuring the voltage on the photoconductive member for a cycle of a print job and generating a voltage measured signal as a function thereof, and control means. The control means compares the voltage measured signal with a target voltage to obtain a voltage error for the cycle of the print job. The control means computes a predicted control signal for the corresponding cycle of the next successive print job as a function of the voltage error. The control means regulates said charging device for the corresponding cycle of the next successive print job as a function of the predicted control signal.

Pursuant to another aspect of the present invention, there is provided a method for controlling voltage potential on a photoconductive member used in an electrophotographic printing machine having a latent image recorded on a photoconductive member during successive printing cycles of successive printing jobs. A step is provided for measuring the voltage potential on the photoconductive member of a cycle of a print job to obtain a measured voltage value. A step is provided for determining a target voltage value for the photoconductive member of the cycle of the print job. A step is provided for calculating an error value for the cycle of the print job as a function of the measured voltage value and the target voltage value. A step is provided for generating a predicted control signal for the corresponding cycle of the next successive print job as a function of the voltage error. A step is provided for regulating a corona generator charging the photoconductive member for the corresponding cycle of the next successive print job as a function of the predicted control signal.

Other features of the present invention will become apparent as the description thereof proceeds and upon reference to the drawings.

BRIEF DESCRIPTION OF THE DRAWINGS

In the detailed description of the preferred embodiments of the present invention, reference is made to the accompanying drawings, in which.

Figure 1:
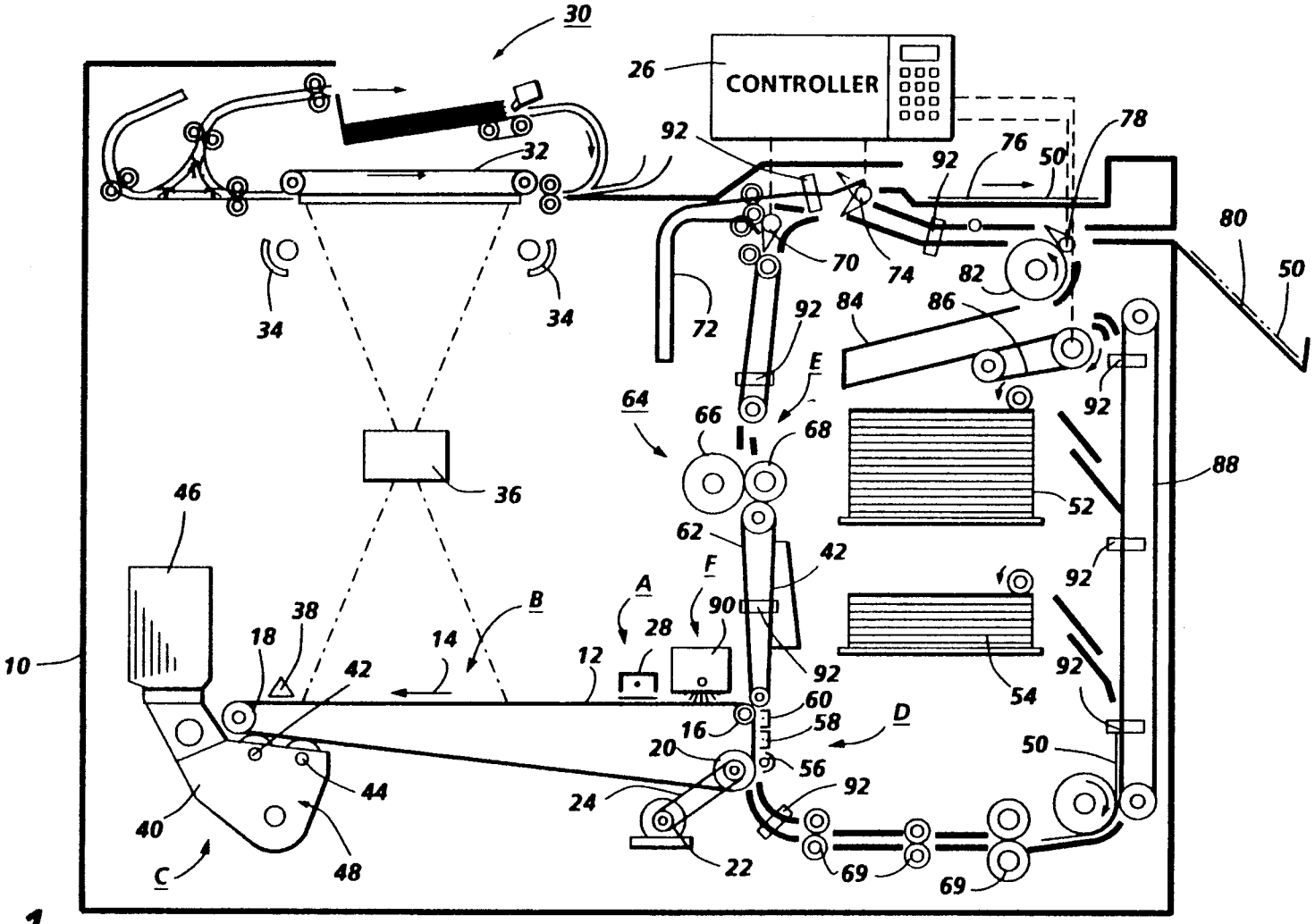
FIG. 1 is a schematic, elevational view showing an illustrative electrophotographic printing machine incorporating the features of the present invention therein.

In the drawings and the following description, it is to be understood that like numeric designations refer to components of like function. While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENTS

Although specific terms are used in the following description for the sake of clarity, these terms are intended to refer only to the particular structure of the invention selected for illustration in the drawings, and are not intended to define or limit the scope of the invention.

Describing now the specific example illustrated in the Figures, there is schematically shown in FIG. 1 an exemplary electrophotographic printing system incorporating the features of the present invention therein. It will become evident from the following discussion that the present invention is equally well suited for use in a wide variety of printing systems, and is not necessarily limited in its application to the particular electrophotographic printing system shown herein.

The exemplary electrophotographic printing system may be a copier 10, for example, the recently introduced Xerox Corporation "Century 5100" copier. The copier 10 employs a photoconductive member such as photoconductive belt 12. Preferably, the photoconductive belt 12 comprises an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diamino-triazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Other well known electrophotographic imaging layers include amorphous selenium, halogen doped amorphous selenium, amorphous selenium alloys (including selenium arsenic, selenium tellurium, and selenium arsenic antimony), and halogen doped selenium alloys, cadmium sulfide and the like. Generally, these inorganic photoconductive materials are deposited as a relatively homogeneous layer.

The anti-curling layer may be from any suitable film forming binder having a flexible thermoplastic resin having reactive groups which will react with reactive groups on a coupling agent molecule. Typical thermoplastic resins include polycarbonates, polyesters, polyurethanes, acrylate polymers, vinyl polymers, cellulose polymers, polysiloxanes, polyamides, polyurethanes, epoxies, nylon, polybutadiene, natural rubber, and the like. A film forming binder of polycarbonate resin is particularly preferred because of its excellent adhesion to adjacent layers and transparency to activating radiation.

The substrate layer may be from any suitable conductive material such as mylar. Another well known conductive material that can be used in the substrate layer is aluminum.

The photoconductive belt 12 moves in the direction of arrow 14 to advance successive portions of the photoconductive surface sequentially through the various processing stations disposed about the path of movement thereof. Belt 12 is entrained about stripping roller 16, tensioning roller 18, and drive roller 20. Stripping roller 16 is mounted rotatably so as to rotate with belt 12. Tensioning roller 18 is resiliently urged against belt 12 to maintain belt 12 under the desired tension. Drive roller 20 is rotated by a motor 22 coupled thereto by suitable means, such as a belt drive 24. A controller 26 controls the motor 22 in a manner known to one skilled in the art to rotate the roller 20. As the drive roller 20 rotates, it advances belt 12 in the direction of arrow 14.

Initially, a portion of the photoconductive surface passes through charging station A. At charging station A, a charging corona generating device 28, hereinafter referred to as a corona generator 28, charges photoconductive belt 12 to a relatively high, substantially uniform potential. The corona generator 28 comprises corona generating wires called the coronode, a shield partially enclosing the coronode, and a wire grid disposed between the belt 12 and the unenclosed portion of the coronode. The coronode wires, by corona discharge, charge the photoconductive surface of the belt 12. The controller 26 is utilized to control the variance of the potential applied to the photoconductive surface of the belt 12 by controlling the potential of the wire grid.

Next, the charged portion of photoconductive belt 12 is advanced through imaging station B. At imaging station B, a document handling unit, indicated generally by the reference numeral 30, provides for automatically feeding or transporting individual registered and spaced document sheets onto and over the imaging station B, i.e., over the platen of the copier 10. A transport system 32 may be an incrementally servo motor driven non-slip or vacuum belt system which is controlled by the copier controller 26, in a manner known to one skilled in the art, to stop the document at a desired registration (copying) position.

When the original document is properly positioned on the platen, imaging of a document is achieved by two Xenon flash lamps 34, mounted in an optics cavity for illuminating the document. Light rays reflected from the document are transmitted through a lens 36. The lens 36 focuses light images of the original document onto the charged portion of the photoconductive surface of belt 12 to selectively dissipate the charge thereon. This records an electrostatic latent image on photoconductive belt 12 which corresponds to the informational areas contained within the original document.

One skilled in the art will appreciate that instead of a light lens optical system, a raster input scanner (RIS) in combination with a raster output scanner (ROS) may be used. The RIS captures the entire image from the original document and converts it to a series of raster scan lines. The RIS contains document illumination lamps, optics, a mechanical scanning mechanism, and a photosensing element, such as charge coupled device (CCD array). The ROS, responsive to the output from the RIS performs the function of recording the electrostatic latent image on the photoconductive surface. The RIS lays out the latent image in a series of horizontal scan lines with each line having a certain number of pixels per inch. The ROS may include a laser, rotating polygon mirror blocks, and a modulator. Other suitable devices may be used in lieu of a laser beam, for example, light emitting diodes may be used to irradiate the charged portion of the photoconductive surface so as to record selected information thereon. Still another type of exposure system employs only an ROS. The ROS is connected to a computer and the document desired to be printed is transmitted from the computer to the ROS. In all of the foregoing systems, the charged photoconductive surface is selectively discharged to record an electrostatic latent image thereon. Thereafter, belt 12 advances the electrostatic latent image recorded on the photoconductive surface towards development station C. After imaging, the original document is returned to the document tray from the transport system 32.

Before reaching the development station C, the photoconductive belt 12 advances beneath a voltage monitor, preferably an electrostatic voltmeter 38 for measurement of the voltage potential of the photoconductive belt 12. The electrostatic voltmeter 38 can be any suitable type known in the art. Typically, an electrometer probe, controlled by a simple switching arrangement, senses the charge on the photoconductive surface of the belt 12. The switch arrangement provides the measuring condition in which voltage is induced on a probe electrode corresponding to the sensed level of the belt 12. The induced voltage is proportional to the internal capacitance of the probe plus its connected circuitry, relative to the probe-to-measured surface capacitance. A simple D.C. measurement circuit is combined with the electrostatic voltmeter circuit. The measuring circuit output can be read by a conventional test meter. The voltage potential measurement of the photoconductive belt 12 is utilized to maintain a uniform potential thereon, as will be understood when the specific subject matter of the present invention is explained in detail.

Thereafter the photoconductive belt 12 advances to the development station C. At development station C, a magnetic brush developer unit, indicated generally by the reference numeral 40, advances the developer material into contact with the electrostatic latent image. Preferably, magnetic brush development system 28 includes two magnetic brush developer rollers 42 and 44. These rollers each advance developer material into contact with the latent image. Each developer roller 42 and 44 forms a brush comprising carrier granules and toner particles. The latent image attracts the toner particles from the carrier granules, forming a toner powder image on the latent image. As successive latent images are developed, toner particles are depleted from the developer 40. A toner particle dispenser 46 is arranged to furnish additional toner particles to a developer housing 48 for subsequent use by developer rollers 42 and 44, respectively. The toner dispenser 46 includes a container storing a supply of toner particles. A foam roller disposed in a sump coupled to the container dispenses toner particles into an auger. The toner particles are then dispensed into the developer housing 48. The belt 12 then advances the toner powder image to transfer station D.

At transfer station D, a copy sheet 50 is moved into contact with the toner powder image. Copy sheets, such as sheet 50, can be conventionally fed from either paper trays 52 or 54 to receive an image. Prior thereto, photoconductive belt 12 is exposed to a pre-transfer light from a lamp 56 to reduce the attraction between photoconductive belt 12 and the toner powder image. Next, a corona generating device 58 sprays ions on the back side of the copy sheet 50. The copy sheet 50 is charged to the proper magnitude and polarity so that the copy sheet 50 is tacked to photoconductive belt 12 and the toner powder image is attracted from the photoconductive belt 12 to the copy sheet 50. After transfer, an optionally included corona generating device 60 charges the copy sheet 50 to the opposite polarity to detack the copy 50 sheet from belt 12. Conveyor 62 advances the copy sheet to fusing station E.

Fusing station E includes a fuser assembly, indicated generally by the reference numeral 64 which permanently affixes the transferred toner powder image to the copy sheet. Preferably, fuser assembly 64 includes a heated fuser roller 66 and a pressure roller 68 with the powder image on the copy sheet contacting fuser roller 66. The pressure roller 68 is cammed against the fuser roller 66 to provide the necessary pressure to fix the toner powder image to the copy sheet 50. (Although not illustrated the following operation occurs.) The fuser roller 66 is internally heated by a quartz lamp. Release agent, stored in a reservoir, is pumped to a metering roll. A trim blade trims off the excess release agent. The release agent transfers to a donor roller and then to the fuser roller 66. The release agent on the fuser roller 66 prevents the toner from sticking to the fuser roller 66, as well as keeping the fuser roller 66 lubricated and clean.

After fusing, the sheet 50 is fed to gate 70 which functions as an inverter selector. Depending upon the position of gate 70, the sheet 50 will be deflected into sheet inverter 72, or will bypass inverter and be fed directly to a second decision gate 74. The sheets which bypass the inverter 72 turn a 90° corner in the sheet path before reaching the gate 74. At the gate 74, the sheet 50 is in a face-up orientation with the imaged side, which has been fused, face-up. If the inverter path 72 is selected, the opposite is true, i.e., the last printed side is facedown. The decision gate 74 either deflects the sheet 50 directly into an open output tray 76 or deflects the sheet 50 into transport path which carries them onto a third decision gate 78. The gate 78 either passes the sheet 50 to an output bin 80 or deflects the sheet 50 onto a duplex inverter roll 84. The inverter roll 64 inverts and stacks the sheet 50, if to be duplexed, in duplex tray 84 when gate 78 so directs. Duplex tray 84 provides an intermediate or buffer storage for those sheets which have been printed on one side and which an image will be subsequently printed on the second, opposed, side thereof, i.e., the sheets being duplexed. Due to sheet inverting by roller 84, the buffer sheets are stacked in the duplex tray 84 face down on top of one another in the order in which they are copied.

In order to complete duplex copying, the simplex sheets in tray 84 are fed in seriatim, by bottom feeder 86 from tray 84 back to transfer station D for transfer of the toner powder image to the opposite side of the sheet. Conveyor 88 advances the sheet 50 along the path which produces an inversion thereof. However, inasmuch as the bottom most sheet is fed from duplex tray 84, the proper or clean side of the sheet 50 is positioned in contact with belt 12 at transfer station D so that the toner powder image is transferred thereto. The duplex sheets are then fed through the same path as the simplex sheets and are stacked in either tray 76 or in output bin 80.

Invariably, after the sheet 50 is separated from photoconductive surface of belt 12, some residual particles remain adhering thereto. These residual particles are removed from photoconductive surface at cleaning station F. Cleaning station F includes a rotatably mounted fibrous brush 90 which comes in contact with photoconductive surface of belt 12. The particles are cleaned from the belt 12 by placing the surface thereof in contact with the rotating brush 90. Subsequent to cleaning, a discharge lamp (not shown) floods the photoconductive surface of belt 12 with light to dissipate any residual electrostatic charge remaining thereon prior to the charging thereof for the next successive imaging cycle.

Controller 26 is preferably a programmable microprocessor which controls all the copier 10 functions hereinbefore described. The controller 26 provides a comparison of sheets delivered to sheets transported, the number of sheets being recirculated, the number of sheets selected by the operator, time delays, jam correction, etc. The control of all exemplary systems heretofore described may be accomplished by conventional control switch inputs from the printing machine console selected by the operator. Conventional sheet path sensors or switches 92 may be utilized for keeping track of the position of sheets. In addition, controller 26 regulates the various positions of the decision gates which are dependent upon the mode of operation selected.

The foregoing description should be sufficient for purposes of the present application for patent to illustrate the general operation of an electrophotographic printing machine incorporating the features of the present invention. As described, an electrophotographic printing system may take the form of any of several well known devices or systems. Variations of specific electrophotographic processing subsystems or processes may be expected without affecting the operation of the present invention.

Referring now to the specific subject matter of the present invention, the general operation will be described hereinafter with reference to FIG. 2.

Figure 2:
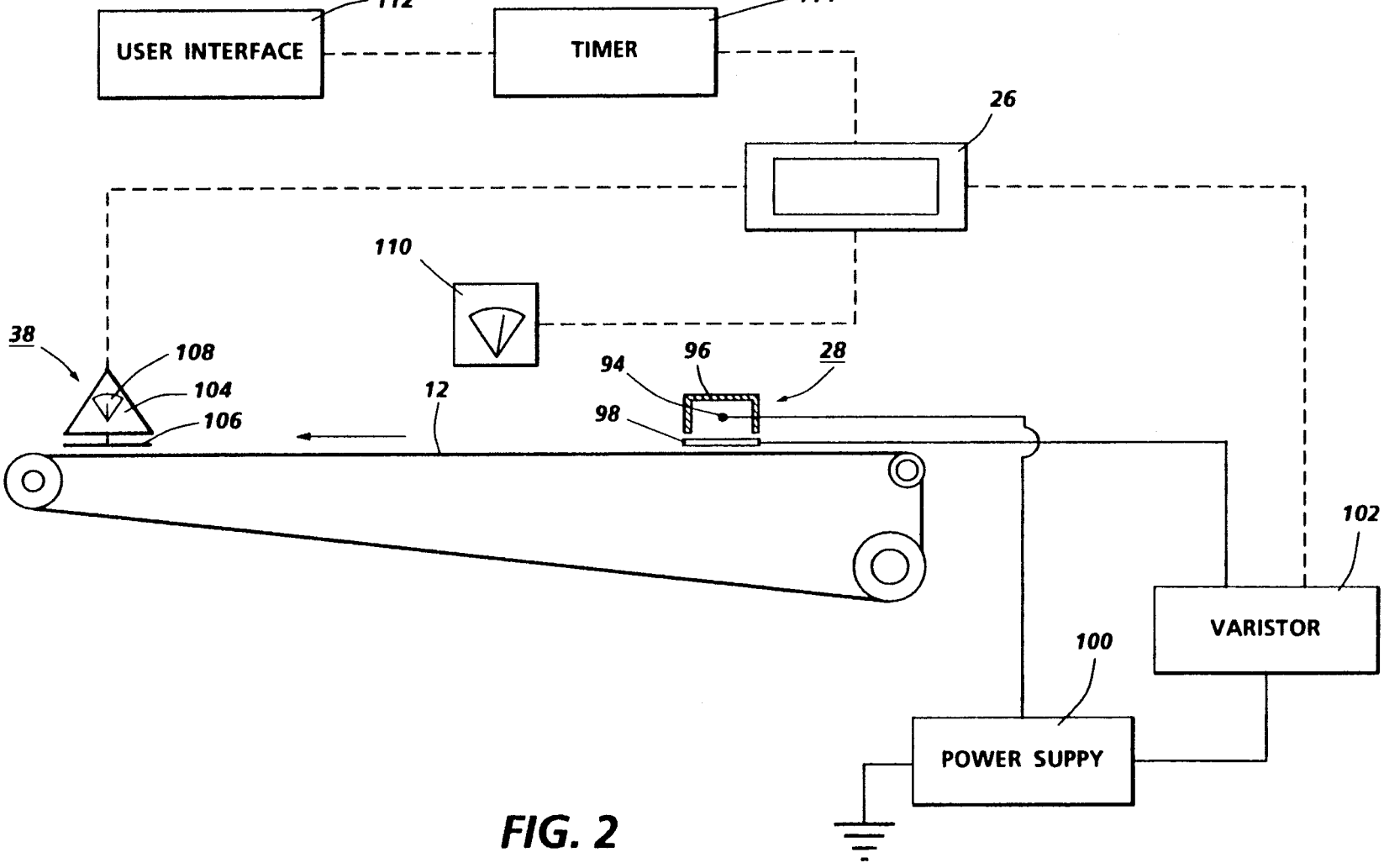
FIG. 2 is an enlarged schematic elevational view showing a corona generator and a voltage measuring device positioned adjacent the photoconductive belt of the illustrative electrophotographic printing machine of FIG. 1.

FIG. 2 illustrates, in greater detail, the operations of charging the photoconductive belt 12 and measuring the voltage potential thereof. The corona generator 28 comprises a fine wire 94, a shield 96 that encloses the wire on three sides, and a wire grid 98 that is positioned under the open side of the shield 96 intermediate to the wire 94 and the photoconductive belt 12. The wire 94 of the corona generator 28 is made of a good conductor, usually tungsten or platinum, and is connected to a power supply 100. The wire grid 98, sometimes called a screen, consists of several thin wires in a grid formation. The grid 98 is connected to the power supply 100 through a varistor 102. During charging, the power supply 100 provides a large DC voltage to wire 94 and the wire grid 98.

As a result, electrostatic fields develop between the charged wire 94 and the shield 96, between the wire 94 and the grid 98, and between the charged wire 94 and the photoconductive belt 12. Electrons are repelled from the wire 94 and the shield 96 resulting in a charge at the surface of the photoconductive belt 12.

The power supply 100 preferably provides a DC voltage operating in the range of approximately 5 kilovolts for powering the device, although greater voltage potentials and/or an AC source may potentially be used. It should be noted, however, that an AC source will be partially attenuated by parasitic capacitances existing within the circuits of the copier 10 and is therefore not preferred. It is preferable that the voltage be less than 10,000 volts in order to avoid sparking or excessive space charges in structures of practical dimensions.

It has been found that the voltage potential on the photoconductive belt 12 is generally proportional to the potential of the wire grid 98. The varistor 102 is composed of conventional circuitry and can be utilized to modify the voltage of the wire grid 98 to help control the charge strength and uniformity on the photoconductive belt 12. The controller 26 controls the modification by the varistor 102 of the wire grid 98 potential based upon information received from the electrostatic voltmeter 38.

The electrostatic voltmeter 38 generally consists of a main body 104 and a probe 106 operably interconnected by a suitable electrical connection. As the photoconductive surface of the belt 12 moves past the probe 106 a rapidly fluctuating signal is produced. A conventional comparator circuit within the main body 104 is then used to determine the voltage on the photoconductive surface. The determined voltage information is then conveyed to the controller 26 for adjustment of the varistor 102. In this manner, the potential on the wire grid 98 can be adjusted to control the voltage on the photoconductive belt 12.

To maintain acceptable copy quality, it is important to maintain a constant voltage potential on the photoconductive belt. The photoconductive belt 12 responds to charge differently depending on the amount of time between subsequent charges thereof. This phenomena is called rest recovery because, among other causes, the charging of the photoconductive belt 12 is affected by the amount of time, the rest time, in which no charge is applied to the photoconductive belt. In general, the more rest time the photoconductive belt is given, the less voltage the charging device must put out in order to get a desired voltage potential on the photoconductive belt.

The adaptive rest recovery algorithm utilized in the present invention strongly depends on the voltage potential of the charging device before rest (the term with predetermined constant $C_A$), the previous jobs voltage correction of the voltage potential of the charging device for the first cycle including accounting for the difference between the desired and measured voltage on the photoconductive surface (the term with predetermined constant $C_B$ and predetermined constant $C_{Vddp}$), the copy length of the job prior to the rest (term with predetermined constant $C_C$), the previous first cycle correction of the voltage potential of the charging device (the term with predetermined constant $C_D$), the net change in voltage of the charging device for a given period, preferably a day, (the term with predetermined constant $C_E$), and an adaptive intercept. The adaptive intercept compensates for any steady state error the algorithm might have because of copier machine to copier machine variance, age of the photoconductive surface, changes in environment and the like. A linear regression analysis was used to help determine the parameters to predict a jobs perfect starting voltage level.

It should be understood a cycle refers to a complete revolution of the belt 12 through the exemplary systems hereinbefore described. A single cycle may generate single or multiple copies depending on the maximum number of images which can be placed on the belt 12. The maximum numbers of images per belt 12 in turn depends on the size of the belt 12. A print job refers to the total number of cycles which generates the total production of copies when a print request is initiated.

A standard linear regression analysis, known in the art, preferably on a data base of over 1000 jobs of random length, rest time, environment, and photoconductive surfaces is performed in order to determine the optimal constants for each variable affecting a particular electrophotographic printing machine. In a simple regression analysis, an equation $y=mx+b$ is derived from the data points on a data chart having x and y axes. The equation utilized in the present invention was derived from a wide range of variable functions to determine a multi-variable equation in which the most significant variables were retained to form the algorithm and the insignificant variables were excluded. By plotting data of the actual results of a large data base for a particular copier using the variables of the algorithms used within the present invention, an equation can be developed for any copier.

The rest recovery correction algorithm can be written as follows:

The voltage correction value for the next job can be the corrected first cycle Voltage grid for the next successive print job or $V_{grid\ correction\ cycle1}=(C_A\times V_{grid\ before\ rest})+(C_B\times\{V_{grid\ correction\ for\ the\ previous\ jobs\ first\ cycle}-[C_{Vdpp}\times(V_{dark\ decay\ potential\ measured\ on\ the\ photoconductive\ surface\ for\ the\ previous\ job's\ first\ cycle}-V_{dark\ decay\ potential\ desired\ or\ targeted\ to\ be\ on\ the\ photoconductive\ surface\ for\ the\ previous\ job's\ first\ cycle})]\}+(C_C\times \text{Copy Length}_{job\ prior\ to\ rest})-(C_D\times V_{grid\ correction\ for\ the\ previous\ job's\ first\ cycle})-(C_E\times V_{net\ grid\ change}\times \text{Rest Recovery Value})+(\text{Adaptive Intercept})$.

The Rest Recovery Value is determined from the value of the natural log of the rest time [In (rest time)].

The Adaptive Intercept is determined as follows:

If the $V_{dark\ decay\ potential}$ minus $V_{dark\ decay\ potential\ target}$ is greater than 0 bits then Adaptive Intercept is decreased by one intercept step size. If the $V_{dark\ decay\ potential}$ minus $V_{dark\ decay\ potential\ target}$ is less than 0 bits then Adaptive Intercept is increased by one intercept size. If the $V_{dark\ decay\ potential}$ minus $V_{dark\ decay\ potential\ target}$ equals zero bits then the adaptive intercept is set equal to the previous determined adaptive intercept. The intercept step size is preferably one bit. Adjustment by only one step size prevents over-correction of the adaptive intercept as well as account for transient errors.

The term ($V_{dark\ decay\ potential\ measured\ on\ the\ photoconductive\ surface}-V_{dark\ decay\ potential\ desired\ or\ targeted\ to\ be\ on\ the\ photoconductive\ surface}$) can also be termed as the voltage error value or $V_{dark\ decay\ potential\ error}$.

It should be understood the voltages are generally discussed in units of bits but can be discussed in any desired quantifier such as voltage. The reason behind this practice is that the controller 26 breaks down information into a set number of bits. For example, an electrostatic voltmeter reading from 0–1500 volts would have its voltage measurements converted by a 255 bit controller to 5.88 volts per bit (1500/255). Likewise, a voltage grid having an output from 0–1595 volts would have its voltage output converted by a 255 bit controller to 6.25 volts per bit (1595/255).

Preferably, the values for the predetermined constants from a standard linear regression analysis known in the art, should be close to the following:

$C_A=0.1677$, $C_B=0.8830$, $C_{Vdpp}=1/.906$ or 1.104, $C_C=0.001678$, $C_D=0.0541$, $C_E=0.0355$, and an Adaptive Intercept of 0.9784.

To illustrate an example of the operation of the algorithm, assume the calculation for the $V_{grid\ correction\ cycle1}$ has been calculated several times and the previous values for the first cycle run of the copier 10 for the previous copy job are as follows:

$V_{grid\ before\ rest}=150$ bits. This voltage charging device before rest value would be determined by viewing the output of the voltage at the end of the previous copy job as determined by a before rest signal produced by either the corona generator 28 or varistor 102 and sent to the controller 26.

$V_{grid\ correction\ for\ the\ previous\ job's\ first\ cycle}=140$ bits. This value would be the result computed for the previous job's first cycle using this same algorithm utilized in the present invention.

$V_{dark\ decay\ potential\ measured\ on\ the\ photoconductive\ surface}=135$ bits. This voltage measured value would be determined from the voltage measurement of the photoconductive surface of the belt 12 by the electrostatic voltmeter 38. In response to the measurement, the electrostatic voltmeter 38 would generate a voltage measured signal to the controller 26.

$V_{dark\ decay\ potential\ desired\ or\ targeted\ to\ be\ on\ the\ photoconductive\ surface}=145$ bits. This target voltage value would be determined by seeing at which uniform voltage potential are the best copies produced.

$\text{Copy Length}_{job\ prior\ to\ rest}=2000$ copies. This copy length value would be determined by recording the number of copies made by the copier 10 during its last copy job. The user interface 112 can generate a copy length signal proportional to the number of copies requested. Alternatively, the photoconductor sensor switches 92 could produce a copy length signal proportional to the number of copies actually printed. The controller 26 would be responsive to the copy length signal in either case.

$V_{net\ grid\ change}=40$ bits. This charging device net voltage change value would be determined by taking the difference, as determined from the charging device voltage signals from either the corona generator 28 or the varistor 102, between the highest voltage on the grid, i.e. after a high quantity copy, and the lowest voltage on the grid, i.e. after a long rest such as in the first print job in the morning office day.

Rest Time=1000 seconds yielding a Rest Recovery Factor of the In(1000) or 6.908. The Rest Time value could be measured by any suitable timing device 114 preferably having an input connected to the user interface 112 which triggers copying.

Based on the above assumed values and the predetermined constants, the equation:

$$V_{grid\ correction\ cycle1} = (C_A \times V_{grid\ before\ rest}) + (C_B \times \{V_{grid\ correction\ for\ the\ previous\ job's\ first\ cycle} - [C_{Vdpp} \times (V_{dark\ decay\ potential\ measured\ on\ the\ photoconductive\ surface\ for\ the\ previous\ job's\ first\ cycle} - V_{dark\ decay\ potential\ desired\ or\ targeted\ to\ be\ on\ the\ photoconductive\ surface\ for\ the\ previous\ job's\ first\ cycle})]\}) + (C_C \times \text{Copy Length}_{job\ prior\ to\ rest}) - (C_D \times V_{grid\ correction\ for\ the\ previous\ job's\ first\ cycle}) - (C_E \times V_{net\ grid\ change} \times \text{Rest Recovery Value}) + (\text{Adaptive intercept})$$

becomes:

$$V_{grid\ correction\ cycle1} = (.1677 \times 150) + (.8830 \times \{140 - [1.104 \times (135 - 145)]\}) + (.001678 \times 2000) - (.0541 \times 140) - (.0355 \times 40 \times 6.908) + (.9784)$$

which further becomes:

$V_{grid\ correction\ cycle1}=(25.155)-(133.368)+(3.356)-(7.574)-(9.809)+(0.9784)=145.47$ or $V_{grid\ correction\ cycle1}=145$ bits.

In this example, the $V_{dark\ decay\ potential\ measured\ on\ the\ photoconductive\ surface} - V_{dark\ decay\ potential\ desired\ or\ targeted\ to\ be\ on\ the\ photoconductive\ surface}$ is less than zero, so the Adaptive Intercept would then be increased by one intercept size of one bit for the next run of the calculation (0.9784 + 1 = 1.9784).

The charge anticipation algorithm requires the controller 26 or an alternative memory storing means to store information of variables used in the algorithm for the first cycle of the previous copy job performed by the copier 10.

It should be understood the controller 26 has inputs from appropriate indicating, recording, and/or memory storing devices or means within the controller indicating the values of the variables used in the rest recovery algorithm—[i.e. the voltage of the wire grid 98 before rest (after use), the calculated voltage grid correction according to the present algorithm for the previous job's first cycle, the voltage measured on the photoconductive surface of the belt 12, the voltage desired or targeted to be on the photoconductive surface of the belt 12, the copy length of the job prior to rest, the net voltage grid change, and the rest time of the copier].

For example, as illustrated in FIG. 2, a voltmeter 110 is electrically connected to the wire grid 98 and the controller 26 to input the voltage on the grid 98 to the controller 26. Alternatively, the varistor 102 could have a voltmeter therein to measure the voltage outputted to the grid 98, enabling the controller 26 to derive the voltage on the grid 98 based on an expected voltage loss between the varistor 102 and the grid 98. Either way, the controller 26 is able to obtain the value of the voltage on the grid 98 or $V_{grid}$ variable. The controller 26 has appropriate means therein to store this value for use in the calculation of the algorithm as well as obtaining the $V_{net\ grid\ change}$ from the difference of the highest and lowest voltages on the grid 98 during a given period.

The controller 26 is also electrically connected to the photoreceptor belt 12. This allows the controller 26 to know when a copy job is finished to determine the $V_{grid\ before\ rest}$. Also, because of this electrical connection, the controller 26 knows the $V_{grid}$ for any cycle.

The electrostatic voltmeter 38 is electrically connected to the controller 26 allowing the controller 26 to know the value of the $V_{dark\ decay\ potential\ measured\ on\ the\ photoconductive\ surface}$.

A user interface 112 is electrically connected to the controller 26 through a timer 114. The user interface 112 is utilized to start the copy process by conveying a message received from a user to the controller 26. From the message received, the controller 26 is able to store the Copy Length$_{job\ prior\ to\ rest}$. The timer 114, connected to the controller 26, is able to measure the time between copy jobs to convey the Rest Time to the controller 26. The controller 26 is then able to determine the Rest Recovery Factor therefrom.

It should be noted that through a linear regression analysis, ideal values, i.e. $V_{grid\ correction\ for\ previous\ job's\ first\ cycle}$, are substituted into the controller 26 for the previous job's first cycle when the copier 10 is brand new so as not to omit any values necessary for calculation of the $V_{grid\ correction}$ for the first cycle run of the very first copy job. Initial values for $V_{dark\ decay\ potential\ desired\ or\ targeted\ to\ be\ on\ the\ photoconductive\ surface}$ and the Adaptive Intercept as well as the predetermined constants can be either inputted to the controller 26 through the user interface 112 or permanently etched into the controller 26 when the copier 10 is new.

The controller 26 has sufficient storing and calculating means therein to store previous calculated $V_{grid\ correction}$ for the previous job's first cycle and the Adaptive Intercept (of the previous job). From the values obtained from the various inputs, the values stored therein, and the inputted predetermined constants, the controller 26 is able to perform the calculations of the present algorithm to determine the rest recovery factor, the adaptive intercept, and the voltage grid correction for the first cycle of the next successive print job. Using the values obtained, the controller 26 generates a predicted control signal which signals the varistor 102 to adjust the voltage on the wire grid 98. In this manner, a uniform potential on the photoconductive surface of the belt 12 can be maintained.

In accordance with the present invention, a second algorithm has been developed to calculate the corrected voltage grid for cycle runs after the first cycle run (in which a cycle is one revolution of the photoconductive belt 12). The second algorithm, hereinafter referred to as the charge anticipation algorithm, remedies the problems of the loss of control decisions due to the distances between the points of charge application and charge measurement.

Figure 3:
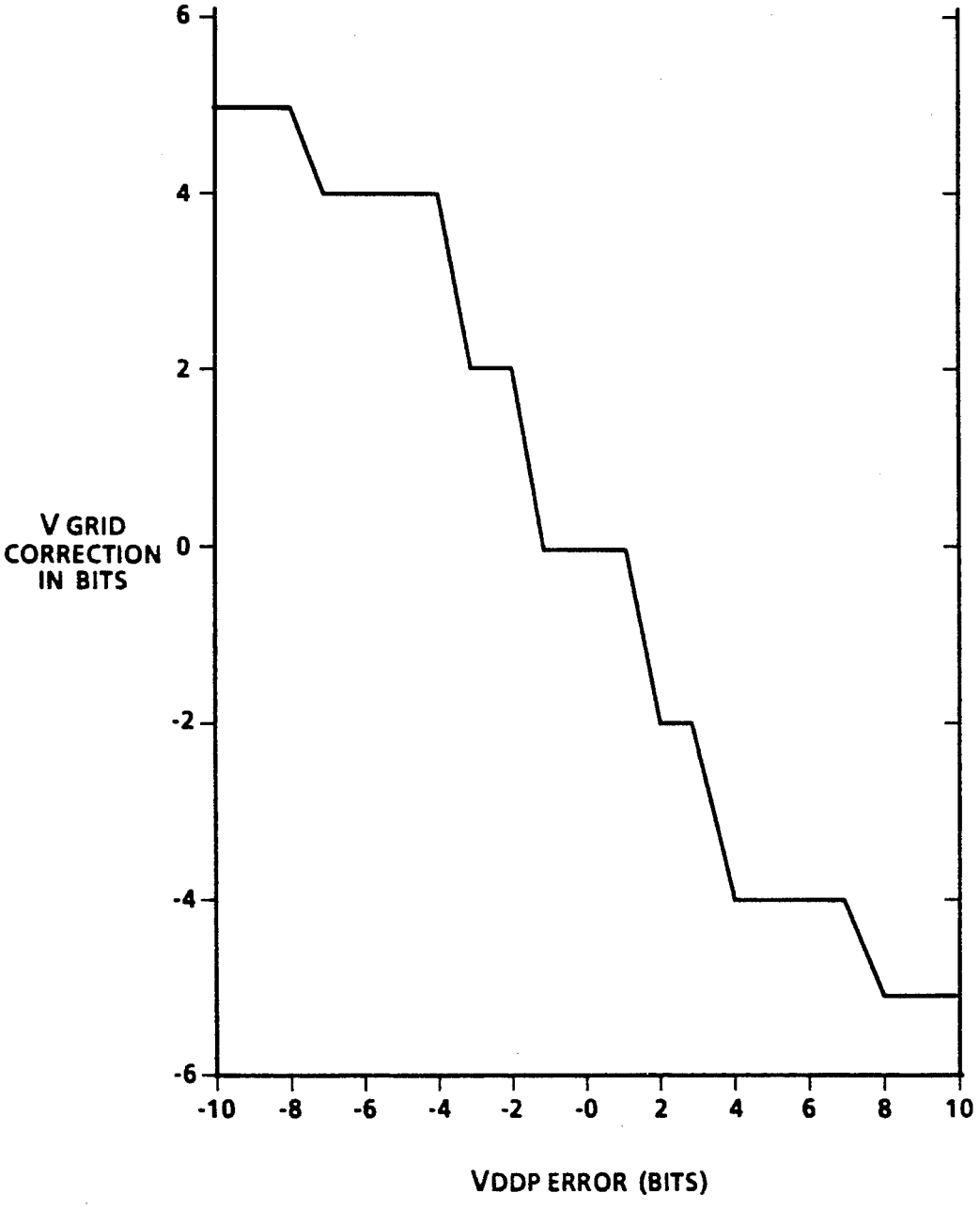
FIG. 3 is a graph illustrating a charge control table for correction of the grid voltage of the corona generator.

In the past, the adjustment of the voltage grid was obtained by correcting for Vddp error according to a charge control table having a negative sloped staircase or platform folding line. A typical table adaptable for use with the "Xerox Century 5100" copier 10 is shown in FIG. 3. The table illustrates a conservative method of providing stable damped control. It should be understood that the lengths of the flat level and sloped portion of the curve can be adjusted by the user to provide either less stable but faster response or more stable slower response.

To illustrate the use of the table of FIG. 3, for example, if the instant job's previous cycles $V_{ddp\ error}$, which equals the $V_{dark\ decay\ potential\ measured\ on\ the\ photoconductive\ surface} - V_{dark\ decay\ potential\ desired\ or\ targeted\ to\ be\ on\ the\ photoconductive\ surface}$, was 6 bits, the $V_{grid\ correction}$ for the next cycle would be a negative 4 bits, in other words, the voltage on the grid would have to be decreased by 4 bits.

The problem with such tables is that they failed to anticipate what the next cycles behavior would be. The charge control algorithm of the present invention utilizes the charge control tables of the prior art to correct for errors in prior cycles of the same job but also includes a factor anticipating what the adjustment of the voltage on the grid 98 should be based on corresponding cycles of previous jobs.

As a result, the charge anticipation algorithm requires the controller 26 or an alternative memory storing means to store information of variables used in the algorithm for a specified number of cycles of the previous copy job performed by the copier 10. It has been found that adjustments made for the voltage potential on the charging devices is optimally made for the first six cycles. Therefore values of variables in the algorithm need only be stored for the first six cycles. Any retention of values beyond six cycles for use in the algorithm is of diminishing return. However, it should be understood that algorithm is not dependent upon the number of cycles being six but can be any desired number of cycles.

The charge anticipation algorithm can be written as follows:

$V_{grid\ adjusted\ cycles_{n>1}\ of\ job_n} = Z(x)$ Table Value $+ V_{grid\ anticipation\ of\ job_n}$ where the voltage anticipation value or $V_{grid\ anticipation\ (cycle_n\ of\ job_n)} = V_{grid\ correction\ (cycle_n\ of\ job_{n-1})} - V_{grid\ correction\ (cycle_{n-1}\ of\ job_{n-1})}$.

For the first cycle ($cycle_{n=1}$), the rest recovery algorithm is applied:

$V_{grid\ correction\ cycle_1} = (C_A \times V_{grid\ before\ rest}) + (C_B \times \{V_{grid\ correction\ for\ the\ previous\ job's\ first\ cycle} - [C_{Vdpp} \times (V_{dark\ decay\ potential\ measured\ on\ the\ photoconductive\ surface\ for\ the\ previous\ job's\ first\ cycle} - V_{dark\ decay\ potential\ desired\ or\ targeted\ to\ be\ on\ the\ photoconductive\ surface\ for\ the\ previous\ job's\ first\ cycle})]\}) + (C_C \times \text{Copy Length}_{job\ prior\ to\ rest}) - (C_D \times V_{grid\ correction\ for\ the\ previous\ job's\ first\ cycle}) - (C_E \times V_{net\ grid\ change} \times \text{Rest Recovery Value}) + (\text{Adaptive Intercept})$.

For cycles two and greater ($cycle_{n>1}$ or $n=2, 3, 4, etc.$) the $\text{Voltage}_{grid\ correction}$ is as follows:

$V_{grid\ correction\ for\ cycle_n (cycle_{n>1})} = V_{grid\ cycle_n} - (C_{Vdpp} \times V_{dark\ decay\ potential\ error\ cycle_n})$, where $V_{dark\ decay\ potential\ error\ cycle_n} = V_{dark\ decay\ potential\ measured\ on\ the\ photoconductive\ surface\ cycle_n} - V_{dark\ decay\ potential\ desired\ or\ targeted\ to\ be\ on\ the\ photoconductive\ surface\ cycle_n}$, otherwise written as:

$V_{grid\ correction\ for\ cycle_n\ (cycle_{n>1})} = V_{grid\ cycle_n} - [C_{Vdpp} \times (V_{dark\ decay\ potential\ measured\ on\ the\ photoconductive\ surface\ for\ cycle_n} - V_{dark\ decay\ potential\ desired\ or\ targeted\ to\ be\ on\ the\ photoconductive\ surface\ for\ cycle_n})]$.

The $V_{grid\ correction}$ is calculated for each of the first six cycles of every job and stored in the memory of the controller 26 for use in calculation of the next job's $V_{grid\ anticipation}$ and thereby the calculation of the $V_{grid\ adjusted}$.

The values for the variables $V_{grid}$ (measured by the voltmeter 110), $V_{dark\ decay\ potential\ measured\ on\ the\ photoconductive\ surface}$ (measured by the electrostatic voltmeter 38) and $V_{dark\ decay\ potential\ desired\ or\ targeted\ to\ be\ on\ the\ photoconductive\ surface}$ (inputted to the controller 26) as well as the constant $C_{Vdpp}$ (inputted to the controller 26) are obtained in the same manner as previously described with respect to the calculation of the rest recovery algorithm.

To illustrate an example of the operation of the charge anticipation algorithm, assume the calculations for the $V_{grid\ correction\ cycle_1}$ and $V_{grid\ adjusted\ cycles_{n>1}}$ have been run several times and the values for the cycle runs of the copier 10 for the previous copy job are as follows:

| Cycle | $V_{grid\ correction\ job_{n-1}}$ (in Bits) |
|---|---|
| 1 | 179 |
| 2 | 187 |
| 3 | 196 |
| 4 | 200 |
| 5 | 203 |
| 6 | 205 |

Assume further the $V_{ddp\ error\ for\ cycle\ 3\ of\ job_{n-1}}$ (which equals the $V_{dark\ decay\ potential\ measured\ on\ the\ photoconductive\ surface\ for\ cycle\ 3\ of\ job_{n-1}} - V_{dark\ decay\ potential\ desired\ or\ targeted\ to\ be\ on\ the\ photoconductive\ surface\ for\ cycle\ 3\ of\ job_{n-1}}$) for cycle 3 of the previous job was a negative 2 bits. Assume further a typical charge control table such as illustrated in FIG. 3 gives a Z(−2) Table Value of +2 bits.

Then $V_{grid\ adjusted\ for\ cycle_3\ of\ job_n} = Z(x)$ Table Value $+ V_{grid\ anticipation\ (cycle_3 of\ job_n)}$, where $V_{grid\ anticipation\ (cycle_3 of\ job_n)} = V_{grid\ correction\ (cycle_3 of\ job_{n-1})} - V_{grid\ correction\ (cycle_2 of\ job_{n-1})}$.

$V_{grid\ anticipation\ (cycle_3 of\ job_n)} = 196 - 187 = 9$ bits.

$V_{grid\ adjusted\ cycles_3} = Z(-2)$ Table Value $+ V_{grid\ anticipation\ (cycle_3 of\ job_{n-1})} = 2 + 9 = 11$ bits.

For simplified version of the charge algorithm calculation, the use of the rest recovery algorithm is omitted resulting in:

$V_{grid\ adjusted\ for\ cycle_n (cycles_{n=or>1})} = Z(x)$ Table Value $+ V_{grid\ anticipation}$, and $V_{grid\ correction\ for\ cycle_n (cycles_{n=or>1})} = V_{grid\ (cycle_n)} - (C_{Vdpp} \times V_{dark\ decay\ potential\ error\ (cycle_n)})$.

The difference being instead of calculating a $V_{grid\ correction\ cycle_1}$, a $V_{grid\ adjusted\ cycles_1}$ would be calculated in lieu thereof. The term $V_{grid\ correction\ (cycle_{n-1}\ of\ job_{n-1})}$ would be set equal to zero for the first cycle. (A $V_{grid\ correction\ (cycle_{n-1}\ of\ job_{n-1})}$ is not necessary for cycle one if $V_{grid\ adjusted\ cycle_n}$ is only calculated for cycles two and greater as in the more complex version of the charge anticipation algorithm explained above.) Also, $V_{grid\ correction\ cycle_{n=1}}$ (calculated in $V_{grid\ anticipation}$ for cycles one and two) would equal $V_{grid} - (C_{Vdpp} \times V_{dark\ decay\ potential\ error})$ as in $V_{grid\ correction}$ for cycles two and greater instead of the value obtained under the rest recovery algorithm.

The controller 26 has sufficient storing and calculating means therein to store the $V_{dark\ decay\ potential\ error\ (cycle_n)}$, $V_{grid\ correction}$, the constants including $C_{Vdpp}$, $V_{grid\ anticipation}$ and the Z(x). From the values obtained from the various inputs and the values stored therein, the controller 26 is able to perform the calculations of the present algorithm to determine the $V_{grid\ adjusted}$. Using the values obtained, the controller 26 generates a predicted control signal which signals the varistor 102 to adjust the voltage on the wire grid 98. In this manner, a uniform potential on the photoconductive surface of the belt 12 can be maintained.

In recapitulation, it is evident that the voltage correction apparatus and method of the present invention obtains information from a cycle of a print job to generate a predicted control signal for the corresponding cycle of the next successive print job. The apparatus and method of the present invention provides for the correction of the voltage on a photoconductive device for the corresponding cycle of the next successive print job as a function of the predicted control signal to maintain a uniform potential thereon to assure high quality images. The utilization of the adaptive rest recovery algorithm by the present invention in the "Xerox Century 5100" has proven to be three times more accurate under a controlled test condition than the use of the classical formula. The utilization of the charge anticipation algorithm by the present invention has also proven three times more accurate under a controlled test condition than the use of the charge control table alone. The improved accuracy in charge control will result in extending the life of the photoconductive member.

It is, therefore, apparent that there has been provided in accordance with the present invention, an apparatus and method for correcting the voltage on a photoconductive device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An electrophotographic printing machine of the type having a latent image recorded on a photoconductive member during successive printing cycles of successive print jobs, wherein the improvement comprises:

a charging device for producing a voltage potential on the photoconductive member;

means for sensing the voltage potential being generated by said charging device and transmitting a charging device voltage signal proportional thereto;

a voltage monitor for measuring the voltage on the photoconductive member for a cycle of a print job and generating a voltage measured signal as a function thereof; and control means for comparing the voltage measured signal with a target voltage to obtain a voltage error for the cycle of the print job, said control means comparing the charging device voltage signal for the cycle of the print job and the voltage error for the cycle of the print job to obtain a voltage correction value for the cycle of the print job, wherein said control means computes the predicted control signal for the corresponding cycle of the next successive print job as a function of the voltage correction value, and regulates said charging device for the corresponding cycle of the next successive print job as a function of the predicted control signal.

2. An apparatus according to claim 1, wherein said control means stores the voltage correction value and compares the voltage correction value for the cycle of the print job and the voltage correction value of a preceding cycle for the cycle of the print job to obtain a voltage anticipation value of the corresponding cycle of the next print job for cycles two and greater, and generates a voltage anticipation value for the first cycle equal to the correction value for the first cycle, wherein said control means computes the predicted control signal for the corresponding cycle of the next successive print job as a function of the voltage anticipation value.

3. An electrophotographic printing machine of the type having a latent image recorded on a photoconductive member during successive printing cycles of successive print jobs, wherein the improvement comprises:

a charging device for producing a voltage potential on the photoconductive member;

means for sensing the voltage potential being generated by said charging device before the end of the print job and transmitting a before rest signal proportional thereto;

a voltage monitor for measuring the voltage on the photoconductive member for a cycle of a print job and generating a voltage measured signal as a function thereof; and control means for comparing the voltage measured signal with a target voltage to obtain a voltage error for the cycle of the print job, said control means computing a predicted control signal for the corresponding cycle of the next successive print job as a function of the voltage error and before rest signal, and regulating said charging device for the corresponding cycle of the next successive print job as a function of the predicted control signal.

4. An apparatus according to claim 3, wherein said sensing means senses the lowest and highest voltage on said charging device during any desired time interval and generates a low voltage signal and a high voltage signal, said control means, responsive to the low voltage signal and the high voltage signal, calculates a net voltage change value as a function thereof, and said control means computes the predicted control signal for any cycle of the next successive print job as a function of the net voltage change value.

5. A method of controlling voltage potential on a photoconductive member used in a electrophotographic printing machine having a latent image recorded on a photoconductive member during successive printing cycles of successive printing jobs, comprising the steps of:

measuring the voltage potential on the photoconductive member of a cycle of a print job to obtain a measured voltage value, and, measuring the voltage potential of the charging device to obtain a charging device voltage value;

determining a target voltage value for the photoconductive member of the cycle of the print job;

calculating an error value for the cycle of the print job as a function of the measured voltage value and the target voltage value, and calculating a voltage correction value for the corresponding cycle of the next successive print job as a function of the voltage value measured during the cycle of the print job and the voltage error value for the cycle of the print job;

generating a predicted control signal for the corresponding cycle of the next successive print job as a function of the voltage error, and for the corresponding cycle of the next successive print job as a function of the voltage correction value for the cycle of the next successive print job; and regulating a corona generator charging the photoconductive member for the corresponding cycle of the next successive print job as a function of the predicted control signal.

6. A method according to claim 5, including:

computing a voltage anticipation value for the corresponding cycle of the next successive print job as a function of the voltage correction value for the cycle of the print job and the voltage correction value of a preceding cycle for the cycle of the print job; and wherein the predicted control signal is generated for the corresponding cycle of the next successive print job as a function of the voltage anticipation value.

7. A method for controlling voltage potential on a photoconductive member used in an electrophotographic printing machine having a latent image recorded on a photoconductive member during successive printing cycles of successive printing job, comprising the steps of:

measuring the voltage potential on the photoconductive member of a cycle of a print job to obtain a measured voltage value;

determining a target voltage value for the photoconductive member of the cycle of the print job;

calculating an error value for the cycle of the print job as a function of the measured voltage value and the target voltage values;

sensing the voltage potential being generated by the corona generator before the end of the print job to produce a before rest signal proportional thereto;

generating a predicted control signal for the corresponding cycle of the next successive print job as a function of the voltage error, and for any cycle of the next successive print job as a function of the rest time signal; and regulating a corona generator charging the photoconductive member for the corresponding cycle of the next successive print job as a function of the predicted control signal.

8. A method of controlling voltage potential on a photoconductive member used in a electrophotographic printing machine having a latent image recorded on a photoconductive member during successive printing cycles of successive printing jobs, comprising the steps of:

measuring the voltage potential on the photoconductive member of a cycle of a print job to obtain a measured voltage value;

sensing the voltage potential being generated by the corona generator to produce a lowest voltage value and a highest voltage value during any desired time interval;

determining a target voltage value for the photoconductive member of the cycle of the print job;

calculating an error value for the cycle of the print job as a function of the measured voltage value and the target voltage value, and calculating a net voltage change value from the difference between the highest voltage value an the lowest voltage value;

generating a predicted control signal for the corresponding cycle of the next successive print job as a function of the voltage error, and for any cycle of the next successive print job as a function of the net voltage change value.

* * * * *